United States Patent [19]

Nagane

[11] 4,380,205

[45] Apr. 19, 1983

[54] GUIDANCE APPARATUS FOR A SEWING MACHINE

[75] Inventor: Masatoshi Nagane, Gotenba, Japan

[73] Assignee: Kabushiki Kaisha Fujimi Hoseisho, Sunto, Japan

[21] Appl. No.: 189,303

[22] Filed: Sep. 22, 1980

[30] Foreign Application Priority Data

Jul. 23, 1980 [JP] Japan ..... 55-100910

[51] Int. Cl.[3] ..... D05B 27/00; D05B 27/12

[52] U.S. Cl. ..... 112/304; 112/322

[58] Field of Search ..... 112/304, 303, 136, 305, 112/318, 322, 153

[56] References Cited

U.S. PATENT DOCUMENTS

| | | | |
|---|---|---|---|
| 3,285,211 | 11/1966 | Hayes et al. | 112/322 X |
| 3,899,986 | 8/1975 | Conner, Jr. | 112/322 |
| 3,994,248 | 11/1976 | Marforio | 112/322 |
| 4,187,795 | 2/1980 | Norton | 112/322 X |

*Primary Examiner*—H. Hampton Hunter

*Attorney, Agent, or Firm*—Fleit & Jacobson

[57] ABSTRACT

An apparatus for advancing limp material such as cloth for overedge stitching. The apparatus has a generally L-shaped arm which is designed to be pivotable in the lateral and upward directions relative to a surface of a working table of a sewing machine. The L-shaped arm has at least a single rotary element for advancing the cloth, the rotary element being driven through a driving pulley and an endless belt. The apparatus has devices for locking the lateral and upward movement against a resilient force of the endless belt.

6 Claims, 13 Drawing Figures

9
9b
9a
8
10'
10
38'
48
34
35
22
20
21
23
24
42
45
33
25
27
19
32
26
46
41
44
43
30
31
47
39
36
40
38
37
7
52
51
50
53
54

GUIDANCE APPARATUS FOR A SEWING MACHINE

BACKGROUND OF THE INVENTION

The present invention relates to guidance apparatus and more particularly to such guidance apparatus for advancing limp material such as cloth or the like relative to a reference point, such as the needle of a sewing machine. More particularly, the present invention relates to the guidance apparatus for a sewing machine of the type which permits a so-called overedge stitches. Briefly, the sewing machine for overedge stitches is designed such that the needle is disposed next to the body of the sewing machine. The sewing machine of the type described is provided with a cutter and is sometimes referred to as a "lock sewing machine" in the industrial field. This type of machine is used primarily for sewing edges of limp materials such as cloth after the edges are cut down to remove excess cloth.

The thus designed sewing machine creates substantial difficulty in providing guidance apparatus for automatically guiding or advancing the cloth as the cloth is fed into the sewing machine for overedge stitching. Further, it is desirable to have a guiding apparatus which can be released so that cloth held by the guiding apparatus which has been completed with desired stitching may be removed from the working area of the machine. Additionally, the guiding apparatus will preferably be housed or nested in a suitable location on the machine so that it will not interfere with the sewing operation.

SUMMARY OF THE INVENTION

An object of the present invention is to provide an improved guiding apparatus which can be readily attached to a sewing machine for overedge stitching without substantial labor or difficulty.

Another object of the present invention is to provide an improved guiding apparatus which can be nested at a suitable location on the said sewing machine without disturbing the sewing operation when the guiding apparatus is not in use.

According to the present invention there is provided a guidance apparatus for a sewing machine having a variable-speed drive unit, a working table, and permitting overedge stitching, said guidance apparatus comprising:

- a shaft rotatably connected to the variable-speed drive unit at one end thereof,
- a driving pulley connected to the other end of the shaft,
- an L-shaped member pivotally connected to the shaft, the L-shaped member being pivotable laterally and vertically relative to a plane of a working table of the sewing machine,
- pulley means rotatably connected to one end of the L-shaped member,
- a first means for locking the lateral movement of the L-shaped member,
- a second means for locking the vertical movement of the L-shaped member, the second means being positioned higher relative to the axis of the driving pulley when said second means and said driving pulley are in their positions of intended use, and endless belt means operatively connecting the driving pulley with the pulley means.

Other and further objects and advantages of the present invention should become apparent from the accompanying description which refers to the accompanying drawings.

In the drawings and accompanying description, preferred embodiments of the present invention are shown and described, but it is to be understood that the drawings and accompanying description are for the purpose of illustration only and do not limit the invention and that the invention will be defined by the appended claims.

BRIEF DESCRIPTION OF THE DRAWINGS

FIGS. 8 through 10, 12 and 13 are side views of modified pulley devices, showing also the point or line of contact with an advancing limp material such as cloth or the like.

DETAILED DESCRIPTION OF THE INVENTION

A preferred embodiment of the invention will be described with reference to the accompanying drawings.

Figure 1:
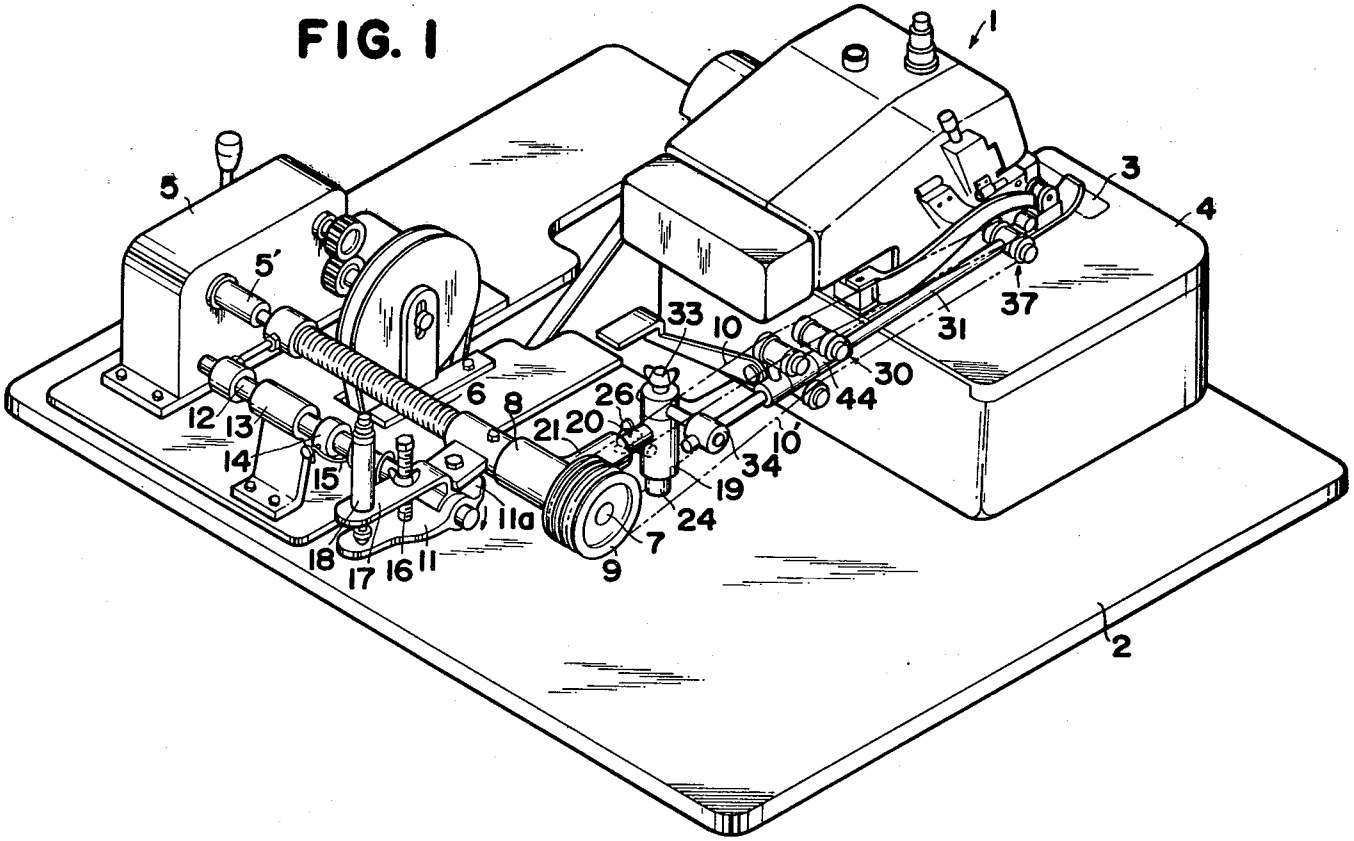
FIG. 1 is a perspective view of a sewing machine of the type concerned, showing a guidance apparatus embodying the present invention.
Figures 4, 5, 6:
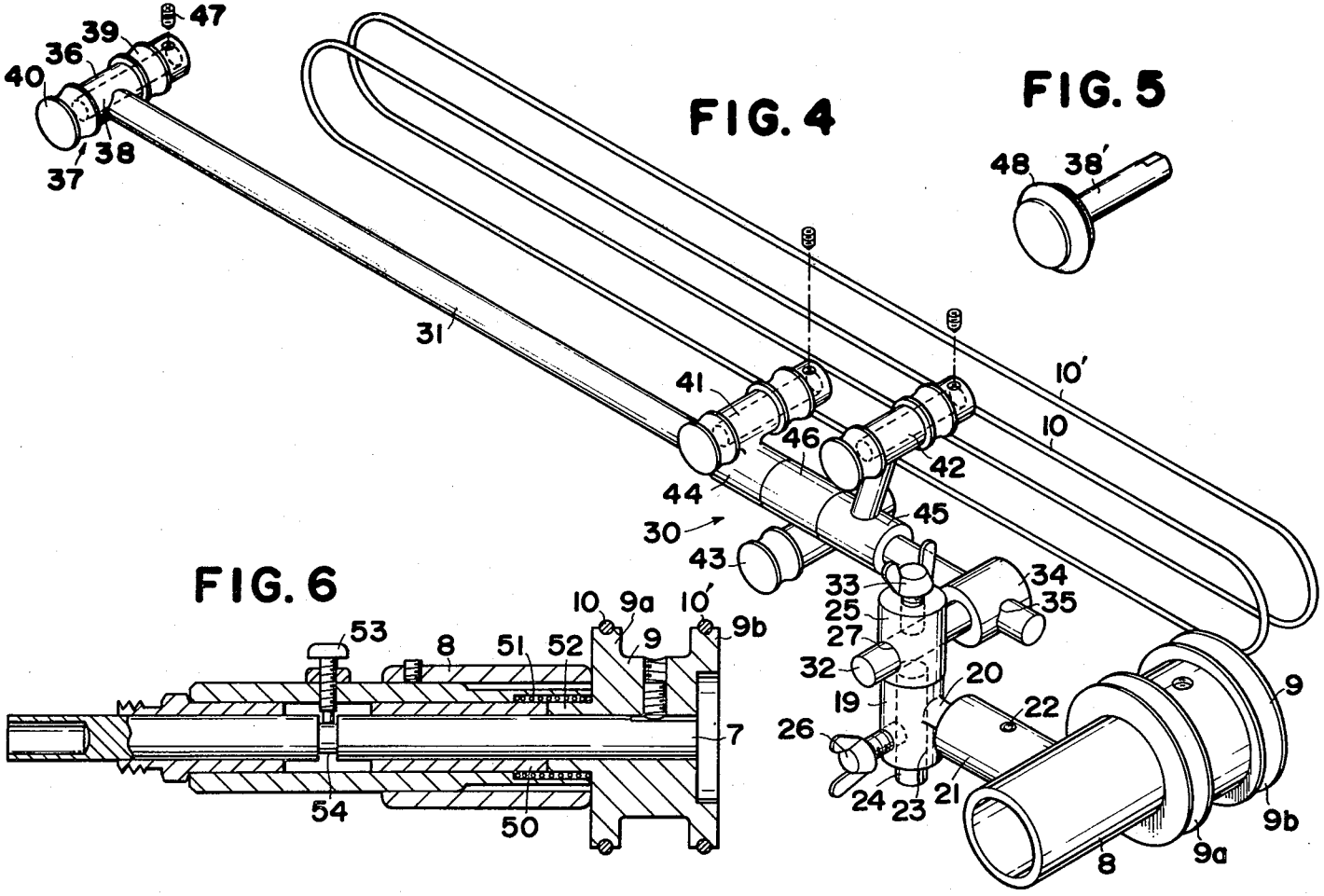
FIG. 4 is a perspective view of the guidance apparatus illustrated in FIG. 1.
FIG. 5 is a perspective view of a pulley device in part, showing a roller to be attached to the pulley device in place of one of the pulleys of the pulley device.
FIG. 6 is a sectional view showing the driving pulley and its associated parts.

Referring first to FIGS. 1 and 4 showing an inventive guidance apparatus in use. A sewing machine of the type capable of overedge stitching which is indicated in its entirety at 1 is installed on a working table 2. The said sewing machine has a variable-speed drive unit 5, a hardened steel insert 3 which is located within a recess in a platform 4 and a needle (not shown) and other elements associated therewith. A detailed description will not be made since this type of sewing machine is well known and these elements are not related to the subject matter of the present invention.

The variable-speed drive unit 5 has an output shaft 5' which is connected to a flexible shaft 6 of coil spring structure, the latter being connected to a rotary shaft 7 which is journaled in a bearing 8. A driving pulley 9 which has an inner pulley wheel part *9a* and outer pulley wheel part *9b* each having a groove for securing therein belts 10, 10' made of urethane rubber is connected to an end of the rotary shaft 7.

The bearing 8 is connected to a two-wing type bracket 11 which is rotatably supported by a beam 12 secured at the predetermined position by means of support 13. A collar 14 is fixed to the beam 12 adjacent to the support 13. A coiled spring 15 is located around the beam 12 and is connected to collar 14 at one end and the bracket 11 at the other. Collar 14 is placed so that the bracket wing *11a* connected to the bearing 8 receives a clockwise directional downward thrust, shown by the arrow, from the spring 15. The thrust is adjusted by an adjustable screw 16 threadedly engaged with an arm 17 fixed to the end of the beam 12. At the end of arm 17 is provided an air cylinder 18 which actuates to pivot the bracket 11 about the beam 12 in the counterclockwise direction. Thus, when the air cylinder is actuated to extend the piston thereof, namely when a string-cutter (not shown) adapted to the sewing machine is actuated, the bracket 11 is pivoted so that the bracket wing where the bearing 8 is fixed is bounded upward.

Referring to FIGS. 1 and 4, connected to the bearing 8 is a vertical sleeve 19 which is positioned between the driving pulley 9 and the sewing machine 1 on the working table 2. In the illustrated embodiment, the sleeve 19 has an arm 20 which is inserted into a cylindrical projection 21 of the bearing 8 and the elements 20 and 21 are connected together by means of connector pin 22, as illustrated in FIG. 4. Alternately, these elements 20 and 21 may be formed integral. The sleeve 19 has a vertical hole 23 through which an extended rod 24 of a columnar member 25 is rotatably inserted, and fixed by a butterfly bolt 26 after the position of the columnar member 25 relative to the sleeve 19 is determined. The columnar member 25 has a hole 27 at right angles to an axial direction of the member 25, the hole 27 being formed at a position higher than the axis of the driving pulley 9 relative to a plane of the working table 2. An L-shaped support rod, which is indicated entirely at 30, has a longitudinal rod 31 extending in the direction at the right angles to the axis of the driving shaft 7 of the pulley 9 and a rod 32 extending in the direction parallel to the axis of the shaft 7. The rod 32 is slidably inserted into the hole 27 of the columnar member 25 and fixed together by means of a wing nut 33 after the rod 32 is determined to be in position. In the illustrated embodiment, the rod 32 has a head portion 34 having an aperture 35 through which the longitudinal rod 31 is adjustably inserted, but the two rods 31 and 32 of the L-shaped support rod 30 may be formed integral.

The L-shaped support rod 30 has at its one end a tubular shaft 36 extending at right angles to the lengthwise direction of the longitudinal rod 31 for rotatably securing a pulley which is designated at 37. The pulley 37 has pulley wheels 39, 40 and axle 38, the latter being journaled in the tubular shaft 36. The driving pulley 9 and the pulley 37 are operatively connected together by means of two endless belts 10, 10' each having a round shape in cross section. As illustrated in FIG. 4, it is preferred that guide pulleys 41, 42, 43 be provided on the L-shaped support rod 30 at the indicated positions. In case the L-shaped support rod 30 is formed with different and independent parts 31 and 32, the guide pulleys 41, 42, 43 can be readily mounted to the longitudinal rod 31 by merely inserting the rod 31 into sleeves 44, 45 and 46 of the guide pulleys 41, 42, 43, respectively.

Figure 7:
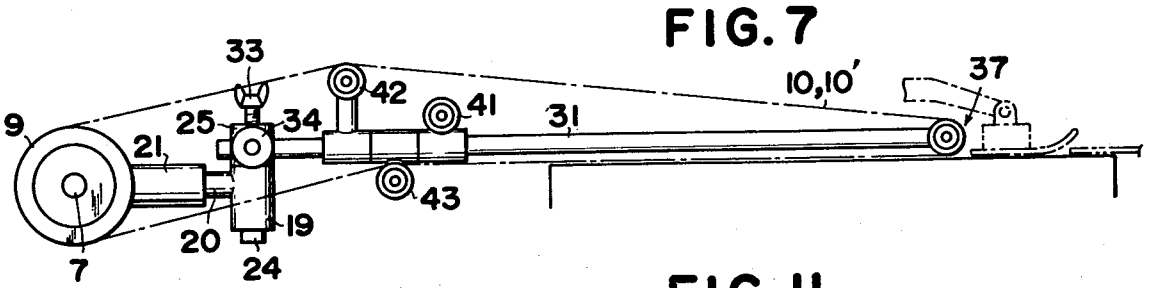
FIGS. 7 and 11 are explanatory side views of the guidance apparatus, showing different manners of provision of an endless belt.

The pulley 37 is constructed so as to meet with various manners of use as illustrated in FIG. 7 et seq., which will be described later. Specifically, the pulley wheel 40 which is connected with the inner pulley wheel part **9*a* is connected with the axle 38 whereas the pulley wheel 39 is detachably fixed to the end of the axle 38 by means of a connector screw 47 so that the pulley wheel 40 may be replaced with a roller 48 which has a axle 38', as illustrated in FIG. 5**.

It is designed that the pulley wheel 40 or otherwise roller 48 be positioned during operation at the immediate rear of a sewing needle (not shown), and that the pulley wheel 39 connected with the outer pulley wheel part **9*b* of the driving pulley 9** is located during operation at the position outside of the sewing needle.

Referring now to FIG. 6 which shows the driving pulley shaft 7 journaled in the bearing 8, a sleeve 50 which has an outer diameter of, for example, 12.1 mm is provided around the rotary shaft 7 connected to the flexible shaft 6. Around the sleeve 50 is provided a coiled spring 51 which has an outer diameter of, for example, 12.0 mm, one end of which is intensely engaged with the sleeve and the other end of which is lightly engaged with a boss 52 of the driving pulley 9. The coiled spring 51 has a spiral direction equivalent to the rotational direction of the driving pulley 9. It will be understood that the coiled spring 51 is provided for the purpose of cancelling or offsetting the reverse torque produced when the rotation of the flexible shaft 6 stops. Specifically, the coiled-spring-type flexible shaft 6 is slightly twisted during operation since spiral or winding direction of the flexible shaft is generally designed to be equivalent to the rotational direction of the driving pulley 9. When the rotational operation of the driving pulley 9 stops, the slightly twisted flexible shaft 6 is untwisted, resulting in a reversing rotation of the driving pulley 9, although slightly. Therefore, a limp material such as cloth which has been advanced ordinarily will retract to produce slackening or seaming cloth, which will become an obstacle to a continuous sewing or stitching of the successive operations. Provision of the coiled spring 51 can avoid such disadvantages as described above. Namely, at the initial rotation of the driving pulley 9 the coiled spring 51 is biased as if it were rotated together with the boss 53 of the driving pulley 9, and a recovery force is imparted on the coiled spring 51, the recovery force being in the direction equivalent to the rotational direction of the driving pulley 9. The recovery force can cancel the reverse torque of the flexible shaft 6 at the time when the driving of the flexible shaft stops, which permits a desired advancing of limp material such as cloth without the above-mentioned disadvantage. In FIG. 6 the reference numerals 53 and 54 are bolt and groove, respectively, for rotatably securing the rotary shaft 7 in position within the bearing 8.

Figure 10:
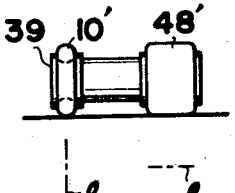
Figure 9:
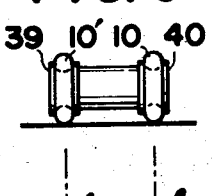
Figure 8:
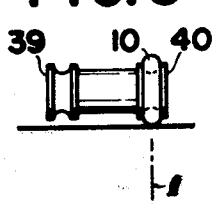

The guiding apparatus according to the present invention can be used in various manners in which the belts 10, 10' have function not only to deliver the rotational force of the driving pulley 9 to the pulley 37 but also to press-advance the limp material such as cloth along an advancing direction of the limp material, as illustrated in FIG. 7. In this case only a single belt 10 may be attached to the inner pulley wheel part **9*a* and the pulley wheel 40 as illustrated in FIG. 8 for the particular purposes of straight-line sewing. FIG. 9 shows two belts applied to the pulley wheels 39, 40, in which the two belts in parallel press-advance the limp material for the purpose of, for example, straight-line sewing. FIG. 10 shows a single belt 10 mounted on the outer pulley wheels 9*a* and 40, and a thick roller 48' which is thicker than the roller 48 in FIG. 5 is provided instead of pulley 39**. Application of such thick roller is desirable for straight-line sewing, but disadvantageous for a curvilinear sew line.

Figure 11:
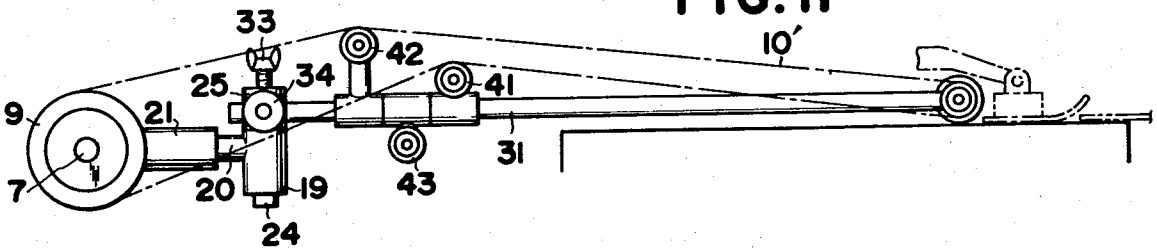
Figure 13:
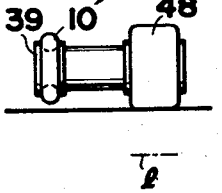
Figure 12:
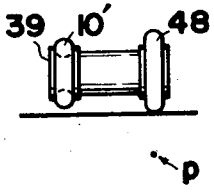

For curvilinear sew line, it is preferred to employ the outer belt 10' which does not contact the limp material and a thin roller as illustrated at 48 in FIG. 5, the thin roller having arc shaped contact surface as illustrated in FIGS. 11 and 12. FIG. 13 shows an outer belt 10' which does not contact a feeding limp material and a thick roller which is the same as the roller 48' in FIG. 10.

In FIGS. 8, 9, 10 and 13, dotted chain lines (l) show a straight contact line between the belt 10 and/or 10' or roller 48' and limp material. A dot (p) in FIG. 12 shows a point-contact between the roller 48 and the limp material.

Figure 2:
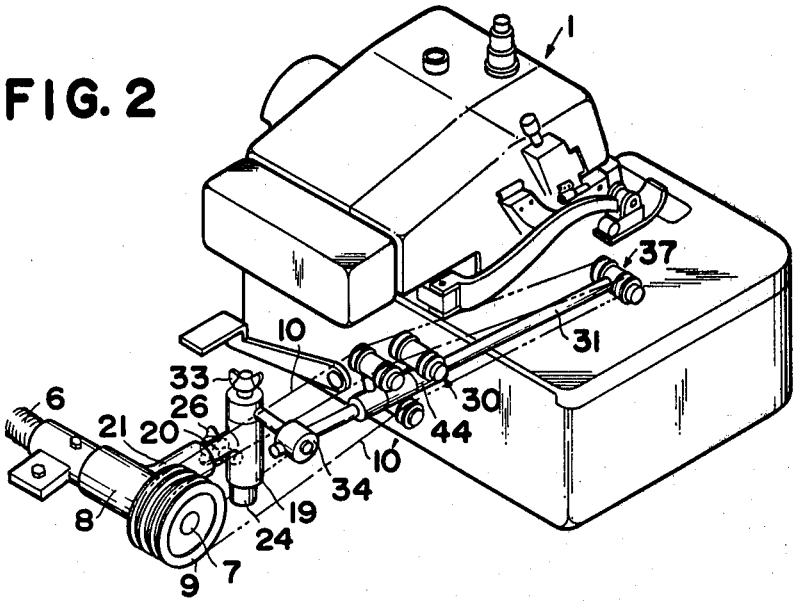
FIGS. 2 and 3 are perspective views of the guidance apparatus illustrated in FIG. 1, showing the operation of the principal elements of the guidance apparatus.
Figure 3:
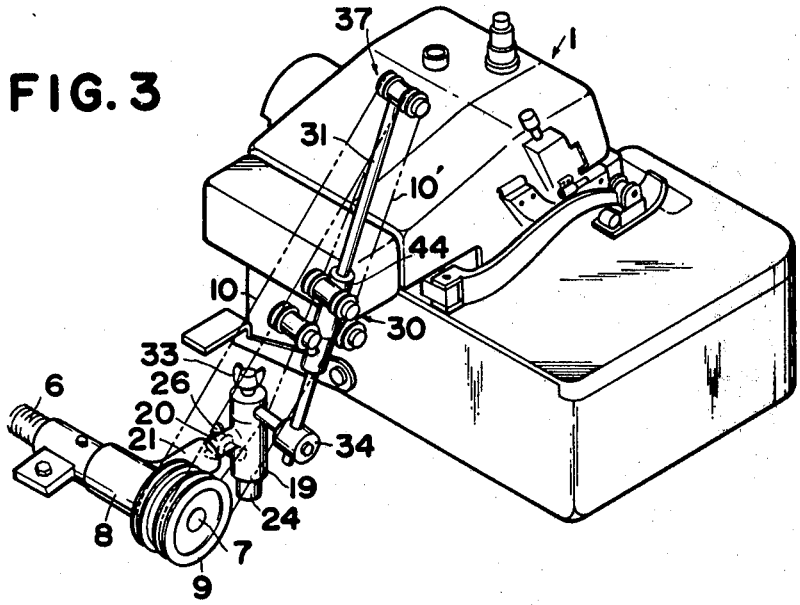

In the guidance apparatus according to the present invention, the connection between the vertical sleeve 19 and the columnar member 25 is located between the driving pulley 9 and the sewing machine 1 and adjacent the latter. This locational arrangement permits a pivotal lateral movement of the L-shaped support rod 30 about an axis of sleeve 19 by means of the resilient force of the belts 10, 10' when the butterfly bolt 26 is released so that the extended rod 24 of the columnar member 25 can be rotated within the vertical hole of the sleeve 19. The lateral movement of the L-shaped support rod is shown in FIG. 2. The other connection between the L-shaped support rod 30 and the columnar member 25 is located higher than the axis of the driving pulley 9. This locational arrangement permits the L-shaped support rod 30 to pivot upward about the rod 32 by the resilient force of the belts 10, 10' when the wing nut 33 is released, as illustrated in FIG. 3. Accordingly, the guidance apparatus, particularly pulley 37 for advancing the limp material, can be rested in a less obstructive position.

Besides the above, the vertical sleeve 19 which is to be fixed to the columnar member 25 by means of the wing nut 26 is connected to the bearing 8 of the driving pulley, and therefore, the pulley 37 can be moved slightly upward when a sewing string should be cut by a cutting device (not shown) which can cooperate with the aforementioned air cylinder 18 (FIG. 1) to pivot the bracket wing 11*a*.

Though the present invention has been described with reference to the preferred embodiments, many modifications and alterations can be made within the spirit of the invention.

What is claimed is:

1. A guidance apparatus for a sewing machine having a variable-speed drive unit and a working table that permits overedge stitching said guidance apparatus comprising:

a shaft rotatably connected to said variable-speed drive unit at one end thereof;

a driving pulley connected to the other end of said shaft;

an L-shaped member pivotally connected to said shaft;

said L-shaped member being pivotable laterally and vertically relative to a plane of the working table of the sewing machine, pulley means rotatably connected to one end of said L-shaped member, a first means for locking the lateral movement of said L-shaped member, a second means for locking the vertical movement of said L-shaped member, said second means being positioned higher relative to the axis of said driving pulley when said second means and said pulley are in their positions of intended use, and endless belt means operatively connecting said driving pulley with said pulley means.

2. The apparatus according to claim 1, further comprising: a flexible shaft disposed between said variable-speed drive unit and said shaft; supporting means for supporting said driving pulley in position, said supporting means having a beam, a leg fixedly supporting said beam, a bracket having two wings extending in the opposite direction and being rotatably mounted on said beam, one of said wings being connected to said shaft, a collar fixedly mounted on said beam, a coiled spring disposed between said collar and said bracket to urge said bracket to rotate in one direction about said beam and an air cylinder disposed at the other wing of said bracket to urge the other wing to rotate said bracket in the other direction, thereby shifting the position of said shaft.

3. The apparatus according to claim 1, wherein said L-shaped member has a first longitudinal bar and a second bar adjustably connected at right angles to said first longitudinal member.

4. The apparatus according to claim 1, further comprising:

an elongated columnar member having a hole for adjustably holding a portion of said L-shaped member, a threaded hole extending from one end of said columnar member to intersect with said hole, a cylindrical projection extending from the other end of said columnar member, and a nut engageable with said threaded hole of said columnar member to engage said L-shaped member with said columnar member, a bearing means for journaling therein said shaft of the driving pulley, and a cylindrical sleeve having a through-hole in the axial direction thereof for rotatably holding therein said cylindrical projection of said columnar member, a threaded hole intersecting said through-hole, and a nut threadedly engaged with said threaded hole to thereby engage said cylindrical projection of said columnar member with said cylindrical sleeve, said cylindrical sleeve being connected to said bearing means.

5. The apparatus according to claim 1, further comprising: bearing means for journaling therein said shaft and said flexible shaft, said flexible shaft being connected at its one end to said variable-driving unit and at its other end to said shaft, said bearing means comprising a cylindrical sleeve slidably mounted on said shaft, said driving pulley having a boss in abutment relation with said cylindrical sleeve, and a coiled spring mounted over said cylindrical sleeve and said boss.

6. The apparatus according to claim 5, in which said coiled spring is firmly engaged at its one end to said sleeve and slightly engaged at its other end to said boss.

* * * * *